US005921768A

United States Patent [19]

Joncg

[11] Patent Number: 5,921,768

[45] Date of Patent: Jul. 13, 1999

[54] FLAME TORCH

[76] Inventor: T. Joncg, 6 F1-6, 186, Section 1, Wen Hsin Rd., Taichung, Taiwan

[21] Appl. No.: 08/943,440

[22] Filed: Oct. 3, 1997

Related U.S. Application Data

[51] Int. Cl.[6] ..... F23Q 7/12

[52] U.S. Cl. ..... 431/255

[58] Field of Search ..... 431/255

[56] References Cited

U.S. PATENT DOCUMENTS 5,304,060 4/1994 Lin ..... 431/255

5,505,614 4/1996 Lin ..... 431/255

*Primary Examiner*—Carroll B. Dority

[57] ABSTRACT

A flame torch includes a body for receiving a lighter therein, a cap mounted to the body with a frame disposed thereto, a nozzle disposed to a front end of the cap with a pipe assembly connected between the lighter and the nozzle, an ignition device received in the cap and being operated by a button member which is movably disposed to a rear end of the cap, a connecting plate movably connected between the button member and a pushing plate of the lighter. The ignition device has a spark tube extending to the nozzle so as to produce a spark when pushing the button member to release gas in the lighter from the pipe assembly. The gas injected from the pipe assembly is ignited by the spark.

4 Claims, 5 Drawing Sheets

FLAME TORCH

BACKGROUND OF THE INVENTION

1. Field of the Invention

The present invention relates to a flame torch and, more particularly, to a flame torch having a lighter received therein which is actuated by a trigger assembly of the flame torch.

2. Brief Description of the Prior Art

A conventional flame torch is operated by actuating an ignition means to produce a spark and in the meanwhile, gas is injected from a reservoir defined in a casing of the flame torch so that the injected gas is burned by the spark. A valve is needed to be disposed to a bottom of the casing so that when the gas in the reservoir is used out, which can be supplied via the valve. The valve should be well sealed to prevent from leakage of gas and this will raise a price of the flame torch. A gas supply tank is required to supply gas into the reservoir and the gas supply tank has a special supply outlet so as to cooperate with the valve to fill up the reservoir. This involves restrictions such that if the gas supply tank is not carried with a use when the gas is used out, the flame torch cannot work.

The present invention intends to provide an improved flame torch which has a lighter received therein so as to be easily replaced when the gas is used out such that the above-mentioned problems are mitigated and/or obviated.

SUMMARY OF THE INVENTION

In accordance with one aspect of the present invention, there is provided a flame torch comprising a body having an open end through which a lighter is received in the body, a cap mounted to the body and having a first opening defined in a front end thereof and a second opening defined in a rear end thereof, a chamber defined in the rear end of the cap and communicating with the second opening so that an ignition means is received in the chamber. A button member is movably disposed to the cap and inserted into the chamber so as to actuate the ignition means when being pushed.

A frame is disposed in the cap and has a front plate extending from a front end thereof. The frame has a first hole defined in the front plate and a second hole defined in the middle portion thereof and a notch defined in a rear end thereof. A nozzle is disposed to the cap and communicates with the first opening, the ignition means having a spark tube extending therefrom and inserted in the nozzle.

A pipe assembly is inserted through the second hole and communicates with the lighter and the nozzle. A rod is movably inserted within the notch and has an upper end thereof connected to a connecting plate and a lower end thereof contacting a pushing plate of the lighter. The other end of the connecting plate is connected to the button member.

It is an object of the present invention to provide a flame torch having a lighter received therein.

It is another object of the present invention to provide flame torch with a lighter received therein which is replaceable.

It is a further object of the present invention to provide a flame torch which is easily to be carried.

It is still another object of the present invention to provide a flame torch wherein gas of the flame torch can be added quickly and easily.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
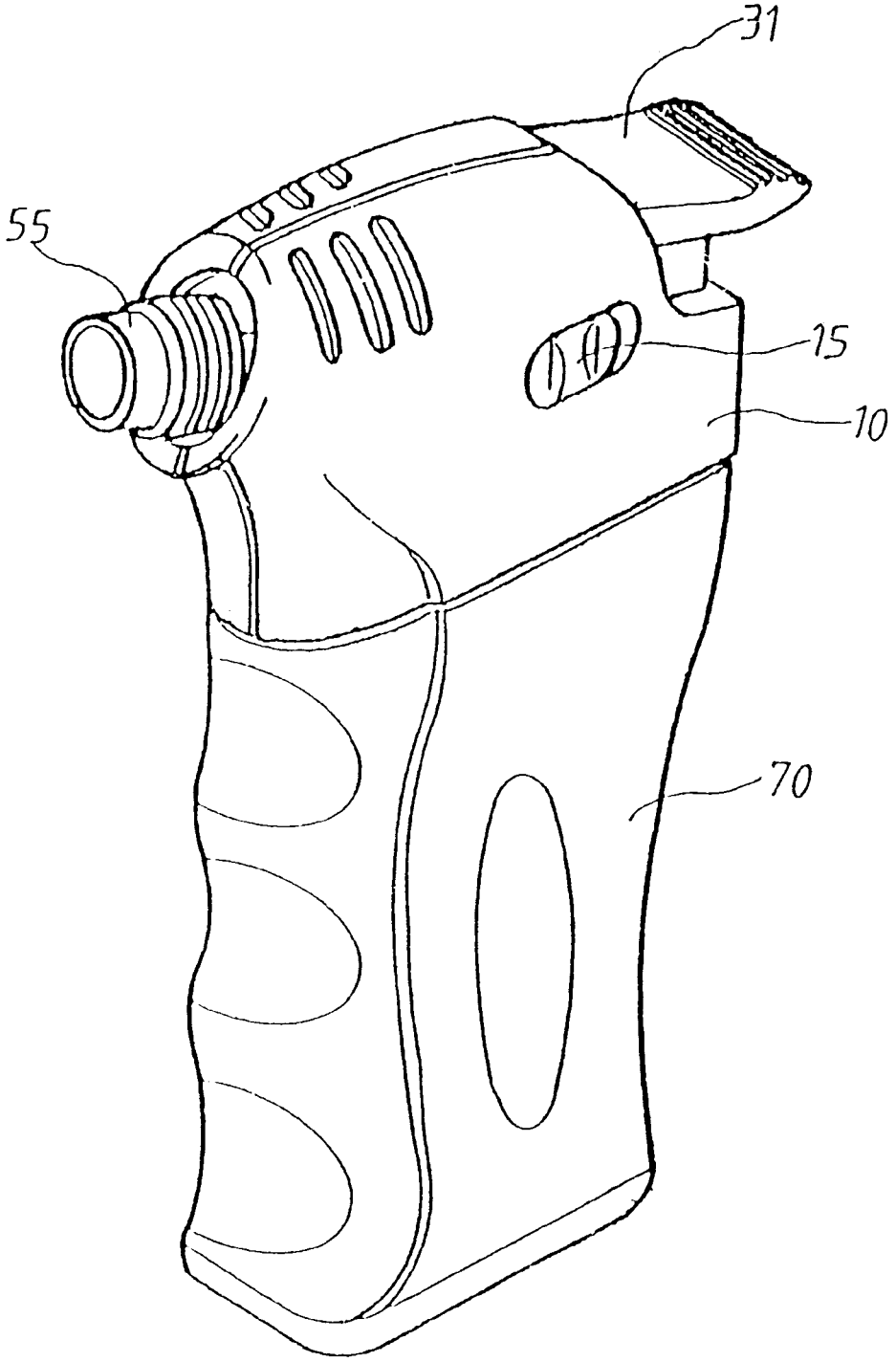
FIG. 1 is a perspective view of a flame torch in accordance with the present invention.
Figure 2:
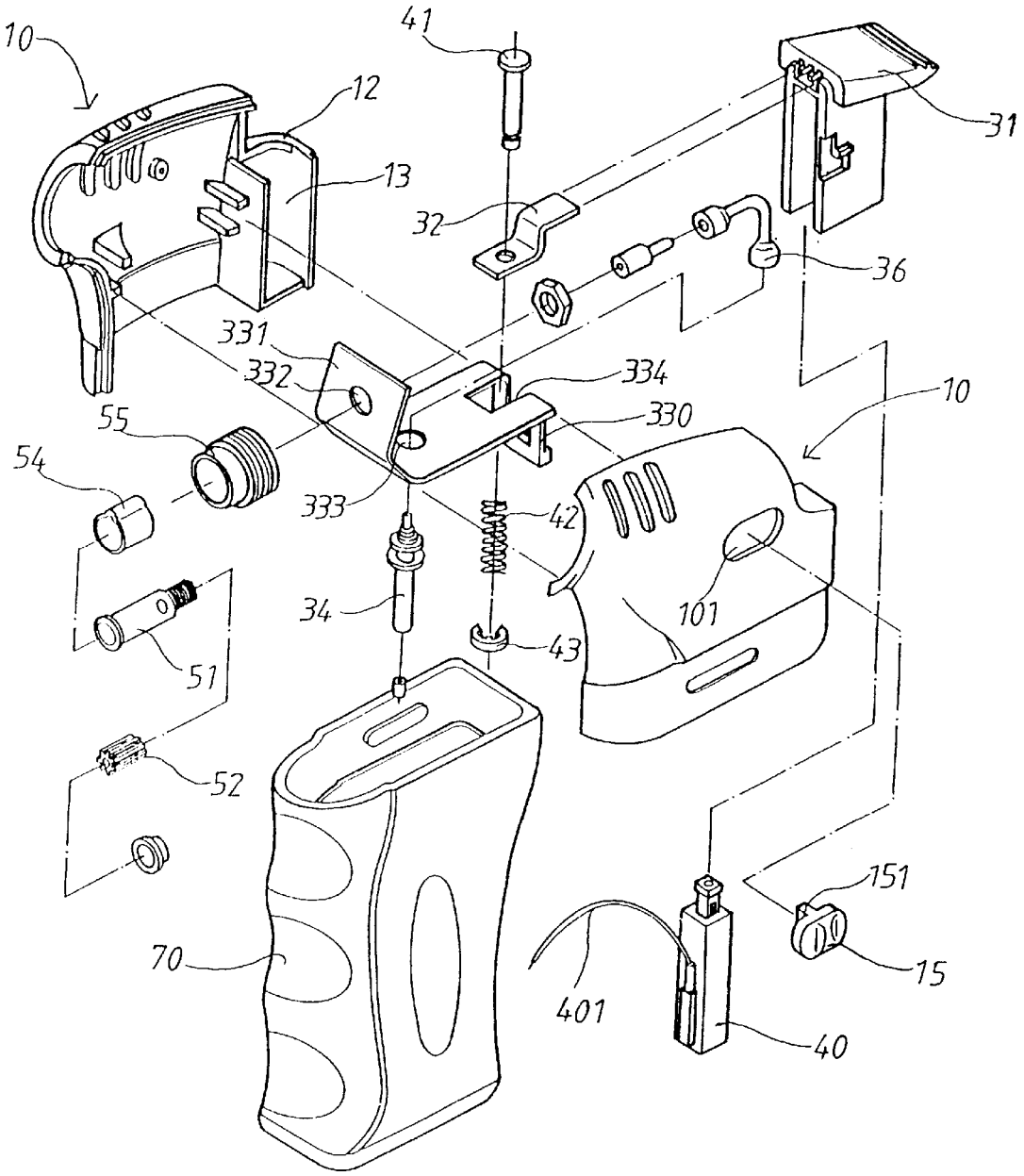
FIG. 2 is an exploded view of the flame torch in accordance with the present invention.
Figure 3:
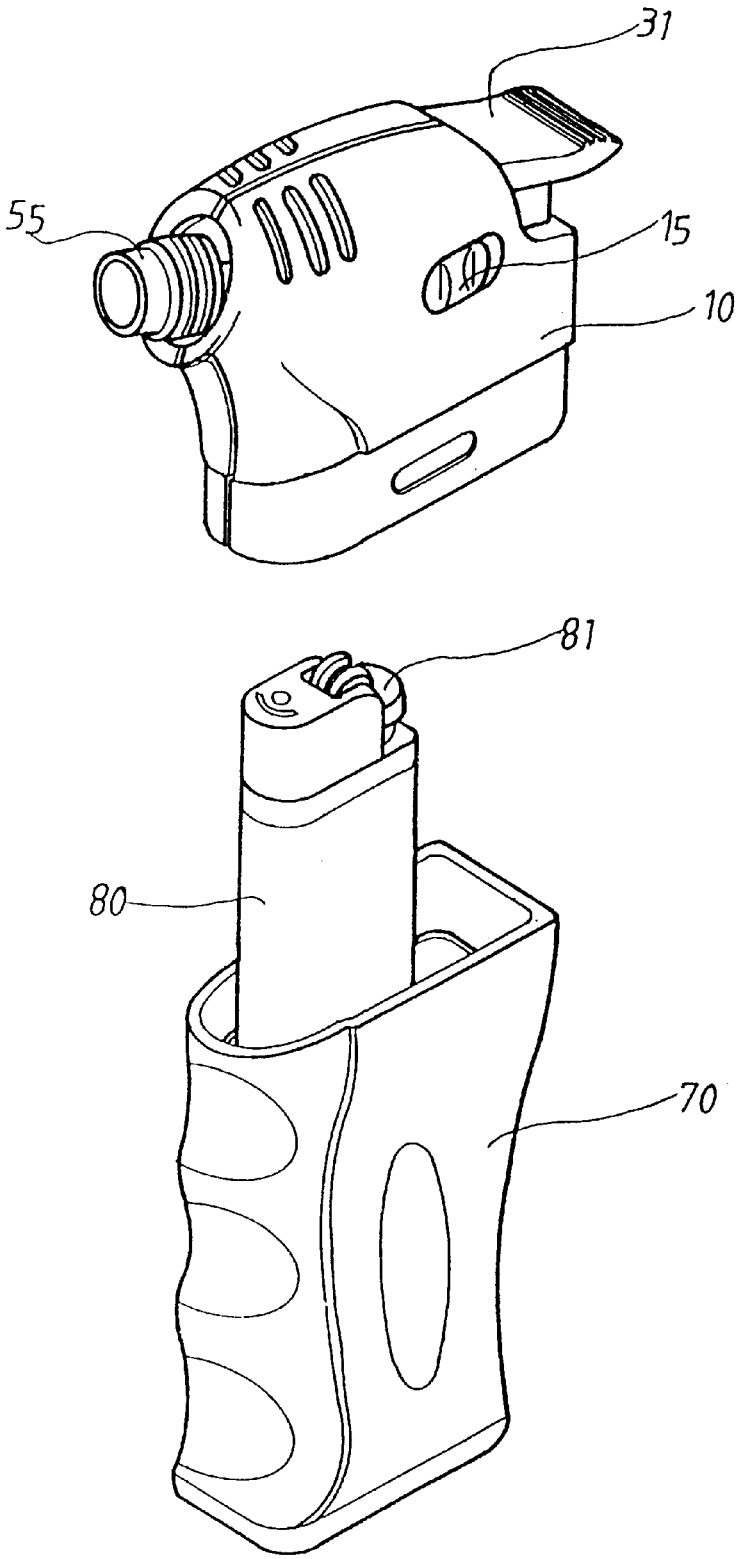
FIG. 3 is an exploded view of a cap and a body of the flame torch wherein a lighter is received in the body.
Figure 4:
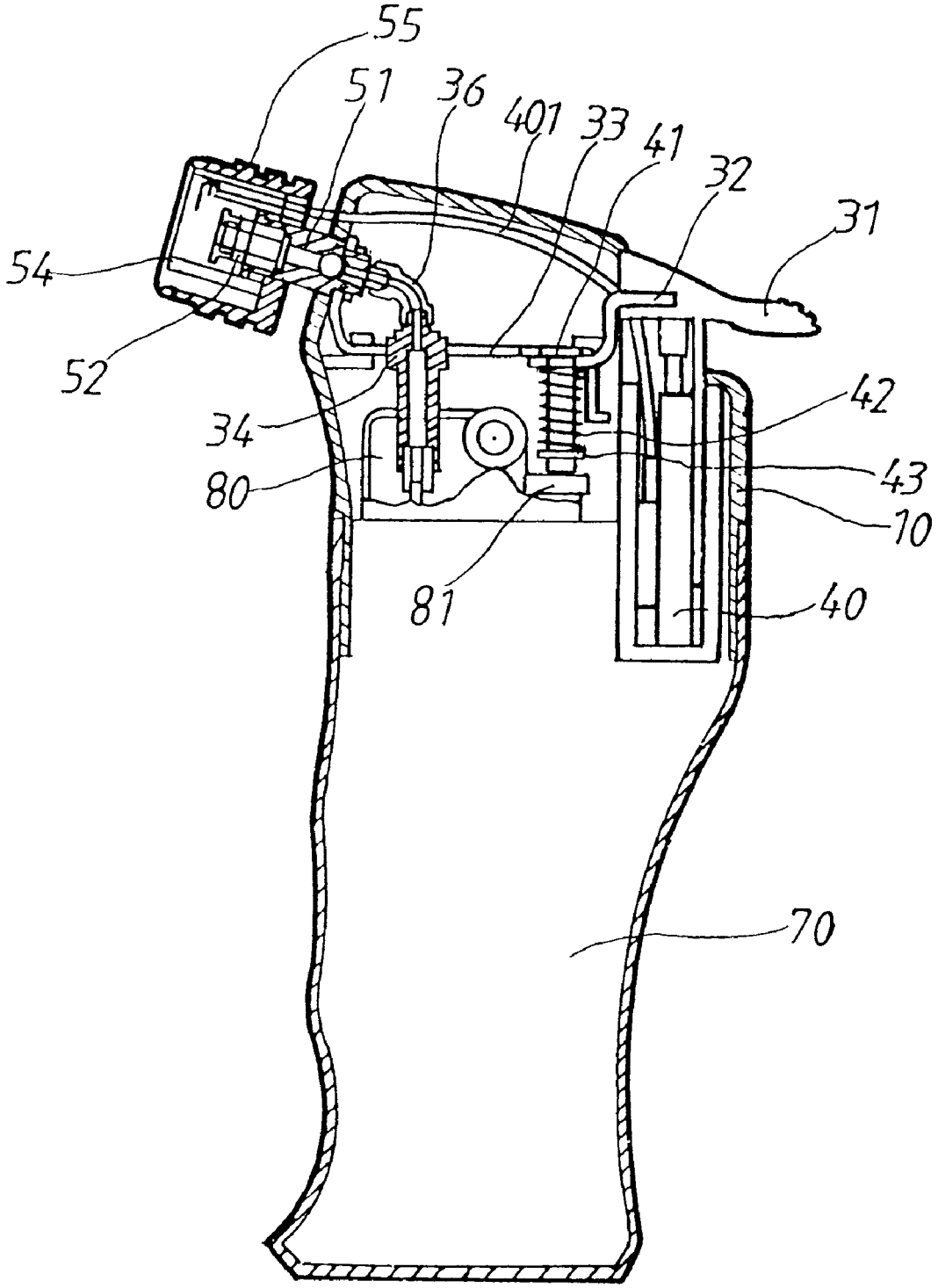
FIG. 4 is a side elevational view, partly in section, of the flame torch.

Referring to the drawings and initially to FIGS. 1 through 4, a flame torch in accordance with the present invention generally includes a body 70 having an open end through which a lighter 80 is received in the body 70. A cap 10 composed of two parts is mounted to the body 70 and has a first opening 11 defined in a front end thereof and a second opening 12 defined in a rear end thereof. One of the two parts of the cap 10 has a slot 101 defined laterally therein so as to receive a safety switch 15 therein. A chamber 13 is defined in the rear end of the cap 10 and communicates with the second opening 12 so that an ignition means 40 is received in the chamber 13. A button member 31 is movably disposed to the cap 10 and inserted into the chamber 13 so as to actuate the ignition means 40 when being pushed.

A frame 33 is disposed in the cap 10 and has a front plate 331 extending upwardly from a front end thereof and a rear plate 330 extending downwardly from a rear end thereof. A first hole 332 is defined in the front plate 331 and a second hole 333 defined in the middle portion of the frame 33 and a notch 334 defined in a rear end of the frame 33 wherein a periphery defining the notch 334 extends through part of the rear plate 330.

A pipe assembly 34 includes a first pipe 34 inserted through the second hole 333 and having a first end inserted into the lighter 80 and a second end thereof connected to a curved tube 36 which is connected to a second pipe 51 extending through the first hole 332 of the frame 33 and the first opening 11 of the cap 10. The second pipe 51 has a ceramic sleeve 54 mounted thereto a pinion member 52 received therein.

A nozzle 55 is disposed to the front end of the cap 10 and fixedly attached to the second tube 51. The ignition means 40 has a spark tube 401 extending therefrom and inserted in the nozzle 55. The spark tube 401 has a distal end thereof located in front of the second pipe 51.

A rod 41 is movably inserted within the notch 334 and has an upper end thereof connected to a connecting plate 32, a lower end of the rod 41 having a C-clamp 43 mounted thereto and contacting a pushing plate 81 of the lighter 80 with a spring 42 mounted between the C-clamp 43 and the connecting plate 32. The other end of the connecting plate 32 is connected to the button member 31.

Figure 5:
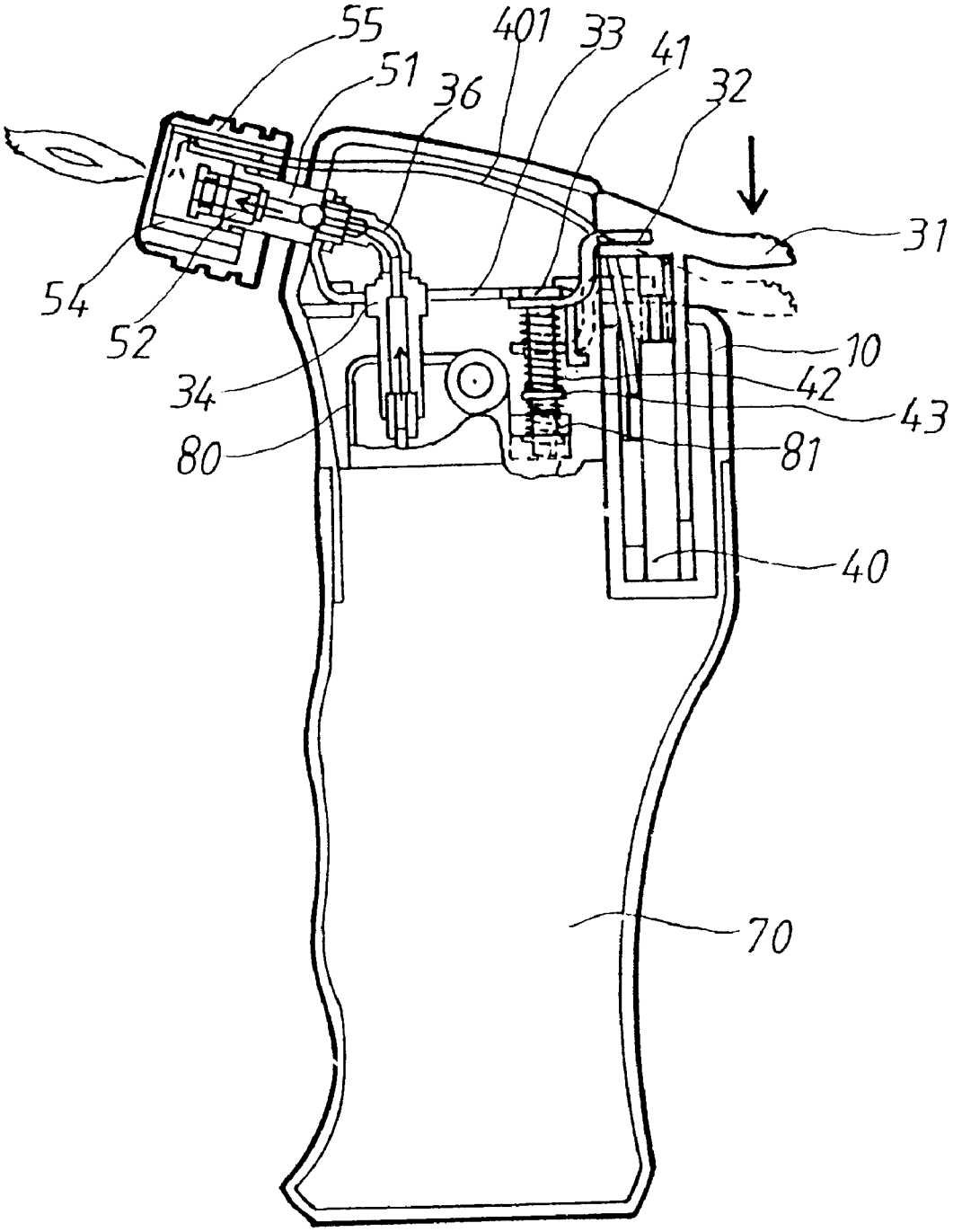
FIG. 5 is a side elevational view, partly in section, of the flame torch when the button member is pushed.

Referring to FIG. 5, when pushing the button member 31 downwardly, the ignition means 40 produces a spark at the distal end of the spark tube 401. Simultaneously, the downward movement of the button member 31 pushes the connecting plate 32 and the rod 41 to push the pushing plate 81 of the lighter 80 so that gas in the lighter 80 ejected from the second pipe 51 and ignited by the spark. Therefore, the flame torch of the present invention receives a lighter 80 therein which is easily replaceable. The safety switch 15 has an extending portion 151 inserted into the cap 10 so as to limit the connecting plate 32 from being moved downwardly so that the button member 31 cannot be pushed if the safety switch 15 is not shifted.

Although the invention has been explained in relation to its preferred embodiment, it is to be understood that many other possible modifications and variations can be made without departing from the spirit and scope of the invention as hereinafter claimed.

What is claimed is:

1. A flame torch comprising:

a body having an open end through which a lighter is received in said body;

a cap mounted to said body and having a first opening defined in a front end thereof and a second opening defined in a rear end thereof, a chamber defined in said rear end of said cap and communicating with said second opening so that an ignition means is received in said chamber;

a button member movably disposed to said cap and inserted into said chamber so as to actuate said ignition means when being pushed;

a frame disposed in said cap and having a front plate extending from a front end thereof, a first hole defined in said front plate and a second hole defined in said middle portion of said frame and a notch defined in a rear end of said frame;

a nozzle disposed to said front end of said cap and communicating with said first opening, said ignition means having a spark tube extending therefrom and inserted in said nozzle;

a pipe assembly inserted through said second hole and communicating with said lighter and said nozzle, and a rod movably inserted within said notch and having an upper end thereof connected to a connecting plate and a lower end thereof contacting a pushing plate of said lighter, the other end of said connecting plate being connected to said button member.

2. The flame torch as claimed in claim 1 wherein said pipe assembly includes a first pipe having a first end inserted into said lighter and a second end thereof connected to a curved tube which is connected to a second pipe extending through said first hole of said frame and is inserted into said nozzle.

3. The flame torch as claimed in claim 2 wherein said second pipe has a ceramic sleeve mounted thereto.

4. The flame torch as claimed in claim 2 wherein said second pipe has a pinion member received therein.

* * * * *